US006080248A

United States Patent [19]

Finck et al.

[11] Patent Number: 6,080,248

[45] Date of Patent: Jun. 27, 2000

[54] NON-DETONATABLE PYROTECHNIC MATERIALS FOR MICROSYSTEMS

[75] Inventors: Bernard Finck, Corbeil; Alain Lefumeux, Kourou; Bernard Mahe, Sorgues, all of France

[73] Assignee: SNPE, Paris, France

[21] Appl. No.: 09/247,520

[22] Filed: Feb. 10, 1999

[30] Foreign Application Priority Data

Feb. 10, 1998 [FR] France ..... 98 01538

[51] Int. Cl.[7] ..... C06B 45/10

[52] U.S. Cl. ..... 149/19.6; 149/76; 149/113

[58] Field of Search ..... 149/19.19, 19.5, 149/19.4, 75, 76, 101, 110, 112, 19.6, 113

[56] References Cited

U.S. PATENT DOCUMENTS

| | | | |
|---|---|---|---|
| 3,745,076 | 7/1973 | Sickman et al. | 149/19 |
| 3,791,892 | 2/1974 | Hammond et al. | 149/19.4 |
| 5,059,175 | 10/1991 | Hanover et al. | 604/891.1 |
| 5,616,884 | 4/1997 | Solberg et al. | 102/351 |

FOREIGN PATENT DOCUMENTS

| | | | |
|---|---|---|---|
| 0 208 983 | 1/1987 | European Pat. Off. | C06B 21/00 |
| 2 737 289 | 1/1997 | France | F41A 1/02 |
| 1 283 691 | 8/1972 | United Kingdom | C06D 5/06 |
| 2 296 248 | 6/1996 | United Kingdom | C08G 18/50 |
| WO 95/09824 | 4/1995 | WIPO | C06B 45/10 |
| WO 98/22719 | 5/1998 | WIPO | F15C 5/00 |

OTHER PUBLICATIONS

Chemical Abstracts: vol. 059, No. 5, (Sep. 2, 1963), XP002083113.

Chemical Abstracts: vol. 118, No. 22 (May 31, 1993), XP000408197.

Chemical Abstracts: vol. 126, No. 21 (May 21, 1997), XP000665445.

*Primary Examiner*—Charles T. Jordan

*Assistant Examiner*—Aileen J. Baker

*Attorney, Agent, or Firm*—Pillsbury Madison & Sutro LLP

[57] ABSTRACT

The invention relates to novel non-detonatable pyrotechnic materials which have a thickness of less than 500 μm or a mass of less than 15 mg, whose combustion is self-sustainable after localized initiation by an electrical power of between 150 mW and 800 mW, for a time of between 20 ms and 600 ms, and which comprise from 25 to 80% by weight of an energy-releasing binder based on poly(glycidyl azide), or on poly(3,3-bis[azidomethyl]oxetane) or on a polyester or polyether and on at least one energy-releasing plasticizer, from 10 to 70% by weight of ammonium perchlorate, the particle size of which is between 0.5 and 30 μm, and from 0% to 45% by weight of at least one nitramine.

These novel materials are used as miniature gas generators, miniature propulsion units or miniature heat generators.

12 Claims, No Drawings

NON-DETONATABLE PYROTECHNIC MATERIALS FOR MICROSYSTEMS

The invention relates to very thin or low-mass non-detonatable pyrotechnic materials, the combustion of which is self-sustaining after localized initiation by a small amount of energy, as well as to their uses. It also relates to the energy-releasing compositions for obtaining these materials.

More particularly, the invention relates to non-detonatable pyrotechnic materials having a thickness of less than 500 μm or a mass of less than 15 mg and which are capable of burning after localized initiation by an electrical power of between 150 mW and 800 mW for a short time.

These novel materials can be incorporated into microsystems and are used, because of the gases and/or heat that they release, as actuators, for example for inflating membranes, for triggering microvalves, for transferring commands in logic circuits for pyrotechnic transmission, for blowing microfuses in electrical transmission circuits, for causing micropropulsion or for initiating the ignition of other materials.

The use of pyrotechnic materials having a thickness of less than 500 μm or a mass of less than 15 mg in Microsystems operating at atmospheric pressure comes up against several difficulties.

On the one hand, the initiation power that they receive in these microsystems is very low and applied for a short time.

On the other hand, some of the energy produced as the combustion of the material progresses does not remain within the latter, because of its small thickness or its low mass, but is dissipated in the surrounding environment. The combustion cannot therefore be self-sustaining. The pyrotechnic material does not burn completely and the desired volume of gas or the desired amount of heat cannot be obtained.

When the pyrotechnic materials are used in microsystems intended for the medical field, the combustion residues must be non-existent, or present in the smallest possible amount, and must not be harmful. Likewise, the gases which are released must themselves be compatible with this application.

The energy-releasing compositions must make it possible to obtain materials having a very small thickness, such as, for example in the form of foils, films, tapes or layers, or having a very low mass, for example in the form of beads, and the composition of the materials obtained must be homogeneous.

It was therefore important to find novel pyrotechnic materials which do not have the aforementioned drawbacks and which meet the requirements for their use in microsystems operating at atmospheric pressure, or at a pressure close to it, and novel compositions for obtaining them.

One object of the present invention is therefore to provide non-detonatable pyrotechnic materials, whose combustion is self-sustainable at atmospheric pressure or at a pressure close to it, comprising an energy-releasing binder and ammonium perchlorate, characterized in that they have a thickness of less than 500 μm or a mass of less than 15 mg, in that their combustion is self-sustainable after localized initiation by an electrical power P such that 150 mW≦P≦800 mW for a time t, such that 20 ms≦t≦600 ms, and in that they comprise:

from 25% to 80% by weight of an energy-releasing binder based on poly(glycidyl azide) (PGA or Cap) or on poly(3,3-bis[azidomethyl]oxetane) (BAMO), or on a polyester and at least one energy-releasing plasticizer, or on a polyether and at least one energy-releasing plasticizer;

from 10% to 70% by weight of ammonium perchlorate, the particle size of which is between 0.5 and 30 μm; and from 0% to 45% by weight of at least one nitramine.

These materials, because of their small thickness or their low mass, because of their ability to be initiated by very low power and to be self-consuming while very rapidly releasing a large quantity of gas and heat, are very useful for acting in microsystems operating at atmospheric pressure or at a pressure close to it.

They may be in any form, but this form must have, according to one of the embodiments, a thickness of less than 500 μm, preferably less than or equal to 300 μm. They may, for example, be in the form of films, foils, tapes or layers. The thickness of these films, foils, tapes or layers is generally greater than or equal to 50 μm, preferably greater than or equal to 100 μm.

According to another embodiment, this form has a mass generally of less than 15 mg, preferably of less than or equal to 3 mg. The materials may, for example, be in the form of beads. Generally, the mass of these materials is greater than or equal to 0.1 mg, preferably greater than or equal to 0.2 mg.

The compounds which form the binders contained in the materials of the present invention are known compounds normally used in the pyrotechnics field. They are commercially available or can be prepared using known processes.

In addition to the abovementioned main components which form the binder, the latter also includes the usual additives such as, in particular, polymerization catalysts and crosslinking agents.

According to an alternative embodiment of the invention, the materials comprise from 30% to 80%, preferably from 40% to 60%, by weight of the PGA- or BAMO-based energy-releasing binder and from 20% to 70%, preferably from 40% to 60%, by weight of ammonium perchlorate.

According to this alternative embodiment, the preferred binder is based on poly(glycidyl azide).

According to another alternative embodiment of the invention, the materials comprise:

from 25% to 70% by weight of the energy-releasing binder based on a polyester or polyether and on at least one energy-releasing plasticizer;

from 10% to 35% by weight of ammonium perchlorate; and from 0% to 45% by weight of at least one nitramine.

As examples of polyesters and polyethers, mention may be made of poly(alkylene glycol adipate)s or poly(poly (alkylene glycol) adipate)s and poly(alkylene glycol)s.

As examples of energy-releasing plasticizers, mention may be made of nitroglycerine (Ngl), butanetriol trinitrate (BTTN), trimethylolethane trinitrate (TMETN) and triethylene glycol dinitrate (TRENO). Preferably, a mixture of several plasticizers is used.

Binders based on polyesters or polyethers and on at least one energy-releasing plasticizer preferably represent from 35% to 50% by weight of the compositions.

A polyester-based binder which is very suitable comprises a poly(diethylene glycol adipate) crosslinked by a polyisocyanate such as tri(isocyanato-6-hexyl)-biuret (BTHI).

The energy-releasing plasticizer is preferably a mixture of TMETN and BTTN.

The amount of ammonium perchlorate in these materials is preferably from 20% to 32% by weight.

Another energy-releasing filler may also be added to these materials, this being chosen from compounds belonging to the class of nitramines such as, for example, octogen or hexogen. A mixture of several nitramines may be used.

The nitramine or nitramines preferably represent from 20% to 35% by weight of these materials.

The size of the perchlorate particles dispersed in the binders according to the invention is important in order to obtain pyrotechnic materials having the desired properties. This size is preferably chosen within the 1 to 10 $\mu$m range.

The power P of the localized initiation that the materials may receive is very low. It is such that 150 mW$\leqq$P$\leqq$800 mW. Preferably, P is greater than or equal to 300 mW. It must be applied for a time t such that 20 ms$\leqq$t$\leqq$600 ms, preferably t$\leqq$125 ms. This condition does not mean that each power P may be applied for any time t lying within this range in order to initiate the material, but that at least one time t exists within this range allowing it to be initiated.

The expression "localized initiation" should be understood to mean initiation carried out on a very small area of material, of about 0.2 $mm^2$, for example on an area of 0.1 mm×2 mm.

The power necessary to activate the material may be provide d by various known means such as, for example, a miniature electrical resistor or by a laser beam.

Having achieved localized ignition of the pyrotechnic material, combustion propagates through the material very rapidly without any other energy supply being necessary. A large amount of gas and heat is then released.

The main gases which form are hydrogen, nitrogen, water vapour, carbon dioxide and/or carbon monoxide.

Another subject of the present invention relates to the compositions for obtaining the materials as described above. They comprise energy-releasing binders, ammonium perchlorate and, optionally, the nitramine or nitramines, and the quantities of these components as defined above.

The usual additives, such as plasticizers, stabilizers, pigments, solvents or fillers which improve the processing or properties of the materials may also be added to these compositions.

The various components are blended together using known techniques, generally by mixing.

The materials may be obtained from these compositions by means of various known techniques, for example by placing the compositions between two plates or in a mould and by curing them under the effect of heat or by evaporating the solvent, or by cutting them from a cured block of larger size obtained beforehand, or else by using the screen-printing deposition technique followed by curing.

Another subject of the present invention relates to several uses of the novel pyrotechnic materials.

These uses are highly varied. Given the properties of these materials, they are suitable for forming part of microsystems such as miniature gas generators, miniature propulsion units or miniature heat generators. In particular, they are used for producing micropump or microvalve systems. Such microsystems are found especially in devices for the transcutaneous administration of medicaments. They are also used for transferring commands in pyrotechnic transmission logic circuits, for forming elements of microfuses in electrical transmission circuits, for serving as ignition initiators or for forming the propulsive charge of miniature propulsion units employed, for example, for modifying the positioning or trajectory of satellites.

The examples which follow illustrate the invention without, however, limiting it:

EXAMPLE 1

A composition was prepared from the following compounds:

| | % by weight |
|---|---|
| PGA-diol of molecular mass 2000 | 57 |
| BTHI | 9.5 |
| Triacetin (plasticizer) | 3.5 |
| $NH_4ClO_4$ (particle size 1 $\mu$m) | 30 |

The compounds were mixed in a horizontal mixer at 50° C. for 3 hours.

A film having the dimensions 2 mm×2 mm and a thickness of 0.1 mm was formed from this composition by polymerization between two metal plates.

Next, the film was initiated using a power of 400 mW applied to a rectangular surface of 0.1 mm×2 mm for 600 ms by means of a miniature electrical resistor. It then burns very rapidly with a uniform flame.

EXAMPLE 2

A composition was prepared from the following compounds:

| | % by weight |
|---|---|
| PGA-diol of molecular mass 2000 | 40.76 |
| BTHI | 6.74 |
| Triacetin (plasticizer) | 2.5 |
| Dibutyltin dilaurate (catalyst) | 50 ppm |
| $NH_4ClO_4$ (particle size 3 $\mu$m) | 50 |

The compounds were mixed in a horizontal mixer at 50° C. for 3 hours.

A film having the dimensions 2 mm×2 mm and a thickness of 0.2 mm was formed from this composition by polymerization between two metal plates. The film was initiated with a power of 800 mW applied to a rectangular surface of 0.1 mm×2 mm for a time of 20 ms by means of a miniature electrical resistor. The initiation temperature is then 300° C. The film burns very rapidly at a rate of 2.3 mm/s.

The amount of heat produced by the combustion is 3654 kJ/g.

The gases released are mainly hydrogen, nitrogen and carbon monoxide.

EXAMPLE 3

A composition was prepared from the following compounds:

| | % by weight |
|---|---|
| Poly(diethylene glycol) adipate of molecular mass 3800 | 8.33 |
| Coupling agent | 0.25 |
| Nitromethylaniline (NMA) | 0.05 |
| Dinitrophenylamine (2-NDPA) | 0.78 |
| TMETN | 19.15 |
| BTTN | 4.78 |
| BTHI | 1.66 |
| $NH_4ClO_4$ | 32 |
| Octogen | 33 |

The compounds were mixed in a horizontal mixer at 50° C. for 3 hours.

The theoretical gas yield of the material is 0.6 l/g.

The main gases released are carbon monoxide, carbon dioxide, hydrogen, nitrogen and water vapour.

What is claimed is:

1. Non-detonatable pyrotechnic material, whose combustion is self-sustainable at atmospheric pressure or at a pressure close to it, comprising an energy-releasing binder and ammonium perchlorate, characterized in that it has a thickness of less than 500 $\mu$m or a mass of less than 15 mg, in that its combustion is self-sustainable after localized initiation by an electrical power P such that 150 mW$\leqq$P$\leqq$800 mW for a time t, such that 20 ms$\leqq$t$\leqq$600 ms, and in that it comprises:

from 25% to 80% by weight of an energy-releasing binder based on poly(glycidyl azide) (PGA), or on poly(3,3-bis[azidomethyl]oxetane) (BAMO), or on a polyester and at least one energy-releasing plasticizer, or on a polyether and at least one energy-releasing plasticizer;

from 10% to 70% by weight of ammonium perchlorate, the particle size of which is between 0.5 and 30 $\mu$m; and from 0% to 45% by weight of at least one nitramine.

2. Material according to claim 1, characterized in that it has a thickness of less than or equal to 300 $\mu$m or a mass of less than or equal to 3 mg.

3. Material according to claim 1 or 2, characterized in that it comprises:

from 30% to 80% by weight of the PGA- or BAMO-based energy-releasing binder; and from 20% to 70% by weight of ammonium perchlorate.

4. Material according to claim 1 or 2, characterized in that it comprises:

from 25% to 70% by weight of the energy-releasing binder based on a polyester or polyether and on at least one energy-releasing plasticizer;

from 10% to 35% by weight of ammonium perchlorate; and from 0% to 45% by weight of at least one nitramine.

5. Material according to claim 1, or 2, characterized in that it comprises:

from 40% to 60% by weight of the PGA- or BAMO-based energy-releasing binder; and from 40% to 60% by weight of ammonium perchlorate.

6. Material according to claim 1 or 2, characterized in that the energy-releasing binder is based on PGA.

7. Material according to claim 4, characterized in that it comprises:

from 35% to 50% by weight of the binder based on a polyester or polyether and on at least one energy-releasing plasticizer;

from 20% to 32% by weight of ammonium perchlorate; and from 20% to 35% by weight of at least one nitramine.

8. Material according to claim 1, or 2, characterized in that the polyester is chosen from poly(alkylene glycol adipate)s or poly(poly(alkylene glycol) adipate)s, the polyether is chosen from poly(alkylene glycol)s, the energy-releasing plasticizer is chosen from the group consisting of nitroglycerine, butanetriol trinitrate, trimethylolethane trinitrate, triethylene glycol trinitrate and mixtures of these compounds, and the nitramine is octogen or hexogen or a mixture of these compounds.

9. Material according to claim 1 or 2, characterized in that the size of the ammonium perchlorate particles is chosen from within the 1 to 10 $\mu$m range.

10. Material according to claim 1 or 2, characterized in that it is in the form of beads.

11. Uncured energy-releasing composition for producing a material according to claim 1 or 2, characterized in that it comprises the compounds and the proportions of those mentioned in any one of claims 1 and 3 to 9.

12. In a method which involves localized initiation and burning of a non-detonatable pyrotechnic material to generate gas and/or heat in the operation of a miniature gas generator, propulsion unit or heat generator, the improvement wherein said pyrotechnic material is a material according to claim 1.

* * * * *